US010399813B2

(12) United States Patent
Kast

(10) Patent No.: US 10,399,813 B2
(45) Date of Patent: Sep. 3, 2019

(54) DEVICE FOR RECEIVING AN EXTRUDED ELASTOMER STRAND DURING TRANSPORT TO A PROCESSING LOCATION

(71) Applicant: CQLT SAARGUMMI TECHNOLOGIES S.A.R.L., Remich (LU)

(72) Inventor: Christian Kast, Merzig-Brotdorf (DE)

(73) Assignee: CQLT SAARGUMMI TECHNOLOGIES S.À.R.L., Remich (LU)

( * ) Notice: Subject to any disclaimer, the term of this patent is extended or adjusted under 35 U.S.C. 154(b) by 125 days.

(21) Appl. No.: 15/532,058

(22) PCT Filed: Dec. 18, 2015

(86) PCT No.: PCT/EP2015/080638
§ 371 (c)(1),
(2) Date: May 31, 2017

(87) PCT Pub. No.: WO2016/097364
PCT Pub. Date: Jun. 23, 2016

(65) Prior Publication Data

US 2017/0305710 A1 Oct. 26, 2017

(30) Foreign Application Priority Data

Dec. 19, 2014 (DE) ..... 10 2014 119 222

(51) Int. Cl.
*B65H 75/14* (2006.01)
*B65H 75/22* (2006.01)
(Continued)

(52) U.S. Cl.
CPC ..... *B65H 75/14* (2013.01); *B65H 49/38* (2013.01); *B65H 75/187* (2013.01); *B65H 75/22* (2013.01);
(Continued)

(58) Field of Classification Search
CPC ..... B65H 75/22; B65H 75/30; B65H 75/185; B65H 75/187; B65H 2701/511
See application file for complete search history.

(56) References Cited

U.S. PATENT DOCUMENTS 3,243,490 A 3/1966 Ulmschneider
3,521,833 A 7/1970 Ridgeway et al.
(Continued)

FOREIGN PATENT DOCUMENTS

DE 1916306 A1 10/1970
DE 9015287 U1 1/1991
(Continued)

OTHER PUBLICATIONS

Machine Translation of DE 199 10 862 A1, Sep. 14, 2000. (Year: 2000).*
(Continued)

*Primary Examiner* — William E Dondero
(74) *Attorney, Agent, or Firm* — Lucas & Mercanti, LLP; Klaus P. Stoffel

(57) ABSTRACT

A device for receiving an extruded elastomer strand, during the transport thereof to a processing location, including a reel that receives the elastomer strand as a winding, wherein the moving reel is provided for temporary inclusion into a production facility that continuously processes the elastomer strand, by rotation of the reel, to form seals for doors or boots of vehicle bodies. The average thickness of the reel resulting from the total mass and the total volume of the material of the reel is <2.5 g/cm$^3$.

16 Claims, 7 Drawing Sheets

(51) Int. Cl.

| | |
|---|---|
| ***B65H 75/30*** | (2006.01) |
| ***B65H 75/18*** | (2006.01) |
| ***B65H 49/38*** | (2006.01) |

(52) U.S. Cl.

CPC ..... *B65H 75/30* (2013.01); *B65H 2515/12* (2013.01); *B65H 2701/3914* (2013.01); *B65H 2701/515* (2013.01); *B65H 2701/5112* (2013.01)

(56) References Cited

U.S. PATENT DOCUMENTS

| | | | | |
|---|---|---|---|---|
| 4,945,938 | A * | 8/1990 | Ponsford ..... | B60P 3/035 137/15.01 |
| 5,921,499 | A | 7/1999 | Forsner | |
| 6,234,421 | B1 | 5/2001 | Cox et al. | |
| 2005/0184191 | A1 | 8/2005 | Van De Camp | |
| 2009/0224091 | A1 | 9/2009 | Ishikawa | |
| 2009/0261195 | A1 | 10/2009 | Chiorgno et al. | |
| 2016/0052746 | A1 | 2/2016 | Kast | |

FOREIGN PATENT DOCUMENTS

| | | | |
|---|---|---|---|
| DE | 4307286 | A1 | 9/1993 |
| DE | 9406120 | U1 | 8/1994 |
| DE | 69603730 | T2 | 12/1999 |
| DE | 19910862 | A1 | 9/2000 |
| DE | 102005028069 | A1 | 5/2006 |
| DE | 102013104049 | A1 | 10/2014 |
| EP | 0598372 | A1 | 5/1994 |
| EP | 0627306 | A1 | 12/1994 |
| ES | 2103160 | A1 | 8/1997 |
| GB | 1275841 | A | 5/1972 |
| WO | 9641762 | A1 | 12/1996 |

OTHER PUBLICATIONS

Machine Translation of ES 2 103 160 A1, Aug. 16, 1997. (Year: 1997).*

* cited by examiner

DEVICE FOR RECEIVING AN EXTRUDED ELASTOMER STRAND DURING TRANSPORT TO A PROCESSING LOCATION

The present application is a 371 of Intentional application PCT/EP2015/080638, filed Dec. 18, 2015, which claims priority of DE 10 2014 119 2222, filed Dec. 19, 2014, the priority of these applications is hereby claimed and these applications are incorporated herein by reference.

BACKGROUND OF THE INVENTION

The invention relates to a device for receiving an extruded elastomer strand during the transport thereof to a processing location, having a reel, which receives the elastomer strand as a coil, wherein the wound reel is provided for temporary inclusion in a production facility that continuously processes the elastomer strand, while the reel is rotated, to form seals for doors or trunks of vehicle bodies.

Devices of this kind, which are manufactured largely from metal, are known from DE 10 2005 028 069 A1 and DE 10 2013 104 049 A1. The reel, which is accommodated in a container, can be fixed within the container during transport. In a raised position, it can be rotated within the container, and the elastomer strand can be unwound therefrom. The abovementioned production system has shaft stubs which can be inserted into the container and the reel core from the outside in order to rotate the reel.

Once the reel has been unwound, the container containing the emptied reel is replaced with a container containing a wound reel, and the container containing the emptied reel is returned to the manufacturer of the elastomer strand.

SUMMARY OF THE INVENTION

It is the underlying object of the present invention to provide a novel device of the type stated at the outset which requires a low outlay on construction and transportation.

The device according to the invention which achieves this object is characterized in that the average density of the reel resulting from the quotient of the total mass and the total volume of the material of the reel is <2.5 g/cm$^3$. The overall volume of material includes pores or the like which are open toward the surface of the material.

It is the underlying insight of the invention that this reel, which is used both for transportation and also temporarily as a functional component of the production facility, can be composed of lighter and therefore less stable materials than in the prior art while providing adequate reliability for transport and production. Consideration may be given, in particular, to foam, paperboard and other fiber materials, which, while taking up approximately the same transport volume for the wound reel as compared with the prior art, provide a significantly improved ratio between the useful transportation load and the total transportation load for the wound reel, allowing improved usage of the volume in terms of the amount of load that can be imposed in restricted transport volumes of transport vehicles. An even greater reduction in the outlay on transport is obtained by means of the present invention by virtue of the fact that the light materials used allow problem-free disposal of the reel at the location where the elastomer strand is processed, thereby making it possible to avoid the outlay for the return of the reel to the manufacturer of the elastomer strand. Conversely, the elimination of the return of the reel provides the possibility of using lighter, less strong materials since there are no durability requirements on the reel. Despite the disposal of the reel, the total outlay for the transportation and processing of the elastomer strand is reduced.

In a preferred embodiment, the reel is composed at least predominantly of material with a density of <2.0 g/cm$^3$, preferably a density <1.5 g/cm$^3$, in particular <1 g/cm$^3$, based on its mass.

The percentage by mass of the material is preferably over 60%, in particular over 70%.

In another preferred embodiment of the invention, at least one part, which is stressed directly by contact by being included in the production facility, comprises a material of higher strength than the remaining parts of the reel.

This at least one part is preferably formed by a ring element, by means of which a reel core and an end part of the reel are connected to one another, preferably by positive engagement.

Such a structure can advantageously be produced with a low outlay on construction and outlay in terms of costs of materials, since only the ring element, for example, need be produced from a higher-grade material which can bear higher stresses than the material of the reel core and the end parts.

In particular, the ring element can be composed of a plastic, preferably recycled plastic, while the reel core and the end parts are produced from paperboard material and/or foam material. Such reels can advantageously be disposed of with little outlay at the processing location after being temporarily installed in the production system, there being a preference for disposal of the parts while maintaining complete separation between types of material, allowing problem-free recycling of the materials.

In one embodiment of the invention, the reel core is of at least partially hollow-cylindrical design and, in particular, can be placed axially on an outer circumferential surface of the ring element.

In a design of this kind, the end part can be enclosed between a flange of the ring element and the end edge of the reel core placed on.

To secure the connection between the reel core and the ring element, a releasable latched connection can expediently be produced, wherein the latched connection has, in particular, a latching tongue that can be bent into the circumferential surface for the purpose of latching in an opening in the cylinder wall of the reel core.

In another embodiment of the invention, the latching tongue has an opening oriented toward the opening in the cylinder wall to allow the passage of one end segment of the elastomer strand. In this way, the opening provided in the cylinder wall of the reel core can advantageously be used both for latching and for guiding through the end of the elastomer strand in order to fix the end of the elastomer strand on the inside of the coil.

Along the edge of the opening in the latching tongue, it is possible to form a web, which forms a ramp by means of which the latching tongue can be bent as the hollow-cylindrical reel core is pushed onto the ring element.

In a circumferential direction before and after the latching tongue and at a distance therefrom, one or more projections for engagement in end slots in the cylinder wall of the reel core can extend from the circumferential surface. Projections forming a guide of this kind advantageously ensure that the opening in the cylinder wall of the reel core always comes into overlap with the latching tongue or the opening formed therein.

In another advantageous embodiment of the invention, projections are provided on the circumferential surface of the ring element in a manner distributed over the circumferential surface to allow internal interlocking with the cylinder wall of the reel core.

On the inside, the ring element can be of a design which deviates from a circular cross section to allow the non-rotatable engagement of a shaft stub of a holding and, optionally, rotary drive device of the production system mentioned, wherein engagement can be possible only in a single correct position, in which the shaft stub allows space for that end of the elastomer strand which projects toward the inside of the ring element.

On the inside, the ring element can have toothing for driving by means of the shaft stub and optionally an axial stop for the shaft stub.

It goes without saying that the ring element has a recess which is oriented toward the latching tongue or opening in the latching tongue and which allows the latching tongue to be bent into the circumferential surface and creates space for the end of the elastomer strand.

A packaging container accommodating the wound reel is preferably composed completely of a material with a density <2.5 g/cm$^3$, preferably of foam, paperboard or some other fiber material, wherein it is also envisaged that the packaging container will be disposed of at the processing location.

For example, the packaging container has vertical supports, in particular four vertical corner supports, in order to form reinforcements for stacking the packaging containers one on top of the other and to form spacers that hold the end parts of the reel at a distance from the associated side wall.

The packaging container can be designed with or without a bottom wall. In the latter case, it can be placed over the reel from above for the purpose of packaging.

The packaging container can have openings oriented toward the ring element, which enable the containers to be unstacked by means of a holding strap.

In a particularly preferred embodiment, for connection to the ring element, the reel core can be inserted axially into a ring pocket of the ring element. The front end of the at least partially hollow-cylindrical reel core can advantageously be clamped in the ring pocket. In contrast to the previously described illustrative embodiment of a reel, it is advantageously possible for the load of the reel core to be dissipated by the ring element not only on the upper half-side but also on the lower half-side of the reel core.

For clamping, it is possible, in particular, for the ring pocket to have radially inward-projecting clamping elements distributed over the ring circumference, wherein clamping elements projecting from mutually opposite inner walls of the ring pocket are preferably arranged offset from one another in the circumferential direction.

For connection to the end wall part, the ring element can be inserted into an opening in the end wall part until the end wall part strikes against a flange and/or a stepped offset.

In another particularly preferred embodiment, the end wall part has two layer segments, which are arranged at a distance from one another and are connected to one another at the edge, and preferably comprises a cutout folded in the manner of a box, in particular a cutout made of paperboard.

In this embodiment, the outer layer segment of the end part can be provided for striking against the flange, and the inner layer segment of the end part can be provided for striking against the stepped offset of the ring element.

In another advantageous embodiment of the invention, said opening in the end wall part is arranged eccentrically with respect to the end wall part. By means of this measure, it is possible to prevent the elastomer strand wound onto the reel from projecting downward beyond the end wall parts of the reel or resting on a base supporting the reel owing to its dead weight. The latter could only be prevented by winding less onto the reel. By means of the abovementioned measure, the holding capacity of the reel can be fully utilized.

In another advantageous embodiment of the invention, in one rotational position relative to the end wall part, the ring element has stop elements which engage behind the layer segments of the end wall part. By means of these stop elements, the ring can be connected to the end wall part in the manner of a bayonet joint. The ring element furthermore preferably has devices for latching the end wall part to the ring element in the rotational position.

For driving the reel, toothing coaxial with the ring axis for the engagement of a correspondingly toothed drive element is preferably provided on the ring element for driving the reel in rotation, wherein the toothing has an angular pitch of <2°. By means of such closely spaced toothing, there is advantageously no need for a particular alignment of the reel with respect to the drive element before engagement. Slight misalignments of the order of at most 1° can be compensated automatically without problems.

By means of the reels described above, it is possible to carry out a method in which an elastomer strand wound onto a reel is transported to a processing location and the wound reel is temporarily included in a production system that continuously processes the elastomer strand, while the reel is rotated, to form seals on doors or trunks of vehicle bodies, wherein, after the elastomer strand has been unwound, the reel is removed from the production system, divided into individual parts and disposed of.

The invention is explained in greater detail below by means of illustrative embodiments and the attached drawings relating to said illustrative embodiments. In the drawings:

DETAILED DESCRIPTION OF THE INVENTION

Figure 1:
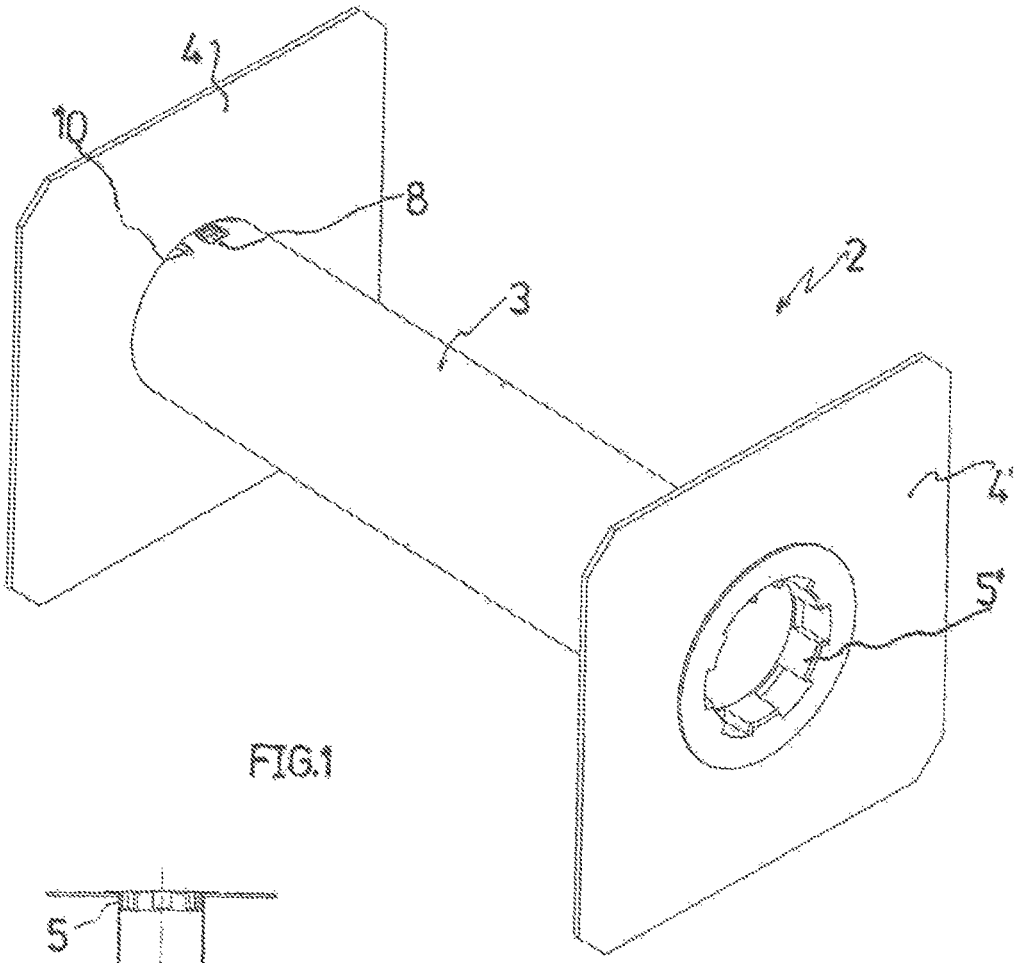
FIG. 1 shows an illustrative embodiment of a reel having a device according to the invention in perspective view.
Figure 2:
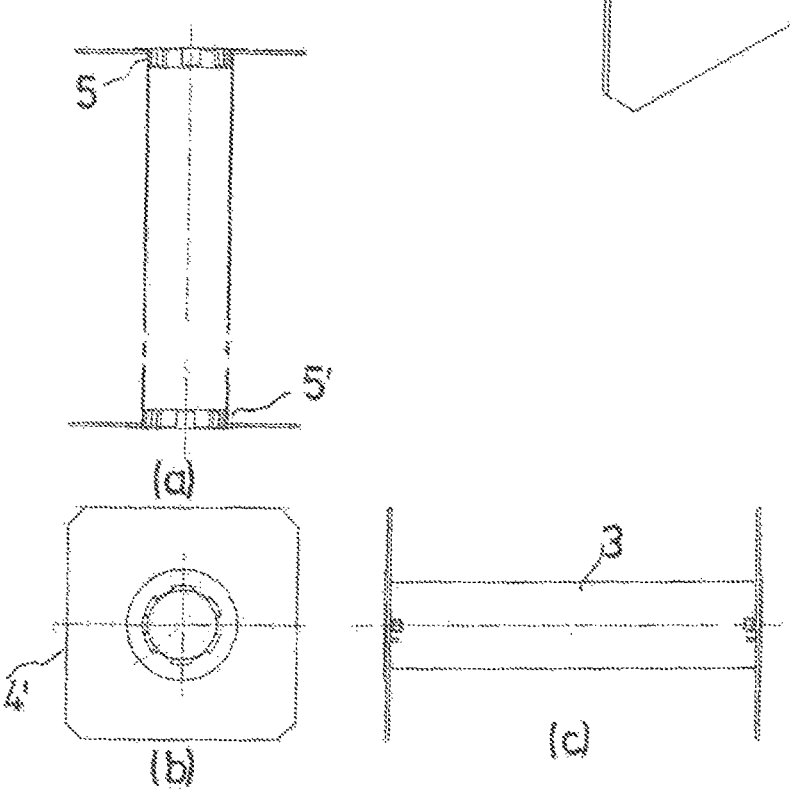
FIG. 2 shows the reel from FIG. 1 in three different views perpendicular to one another.
Figure 3:
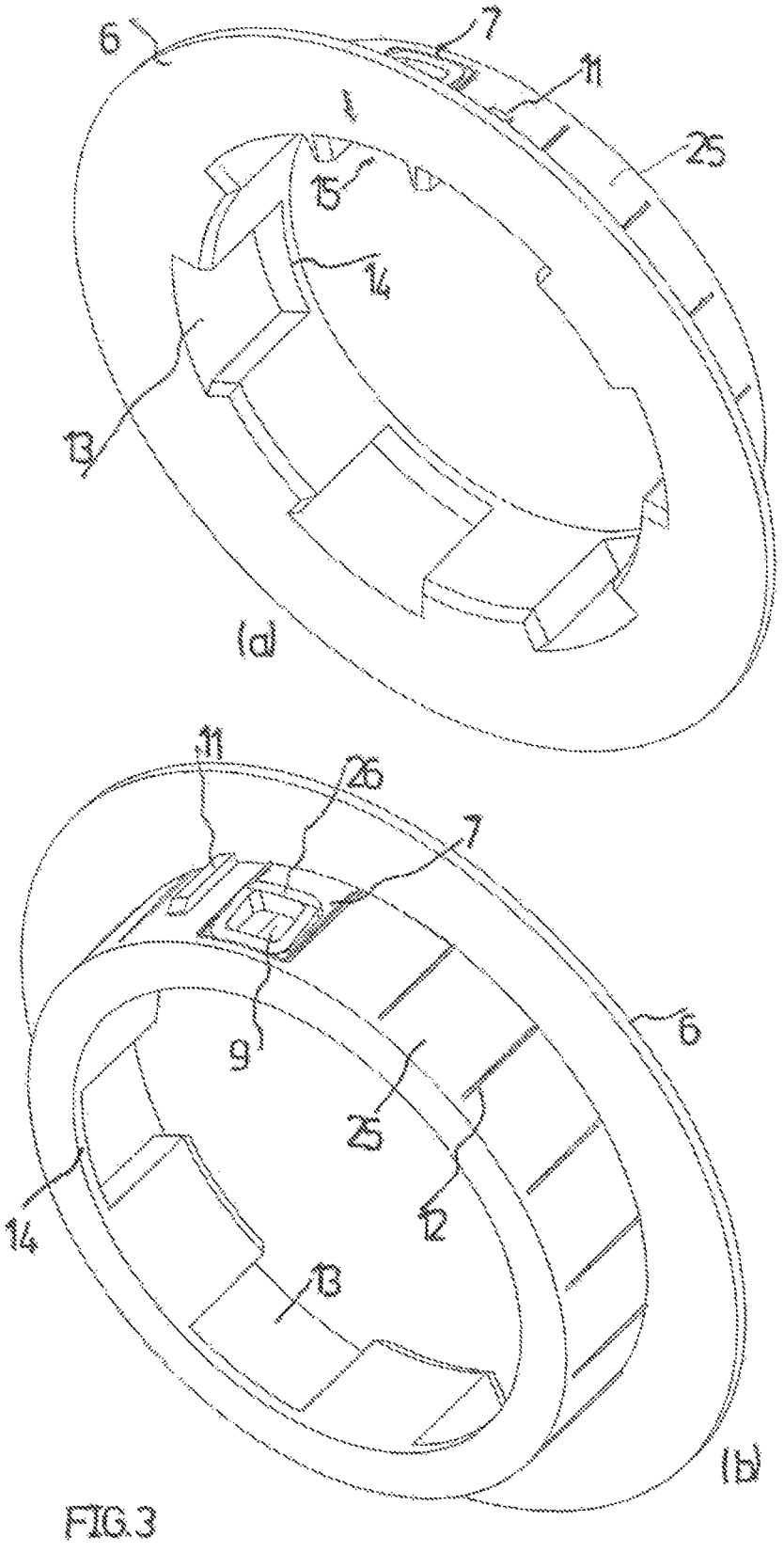
FIG. 3 shows a ring element used in the device in FIG. 1.

A reel 2 provided for receiving a coil consisting of an elastomer strand 1 for the formation of seals on vehicle bodies comprises a hollow-cylindrical reel core 3 and two correspondingly designed end wall parts 4, 4'. The reel core 3 and the end wall parts 4, 4' are composed of paperboard material, wherein the cylinder wall of the hollow-cylindrical reel core 3 is formed from spirally wound interconnected webs. The cylinder wall of the reel core could also be produced uniformly from fiber material.

At its ends, the reel core 3 is connected to each of the end wall parts 4, 4' by means of a ring element 5 and 5' respectively. In the illustrative embodiment shown, the correspondingly designed ring elements 5, 5' are composed of a recycled plastic and are produced integrally by injection molding.

The connection between the reel core 3 and the end wall parts 4, 4' by means of the ring elements 5, 5' is established by the fact that the end wall parts 4, 4' are each enclosed between a flange 6, 6' of the ring elements 5, 5' and the associated end edge surface of the hollow-cylindrical reel core 3, which is pushed onto a circumferential surface 25 of the ring elements 5, 5'. To secure this positive connection, a latching tongue 7 that is formed on each of the ring elements 5, 5' and can be bent into the circumferential surface 25 furthermore latches into an opening 8 in the cylinder wall of the reel core 3. The latching tongue 7 itself has an opening 9, which, in the latched state, is oriented toward the opening 8 in the cylinder wall of the reel core 3 and serves to receive and fix that end of the elastomer strand 1 which is situated on the inside of the coil.

On one side of the opening 8, the cylinder wall of the reel core 3 has an end slot 10, in which a ridged projection 11 on the ring element 5, 5' engages. This ensures that the openings 8 and 9 come into overlap.

The openings 8 and end slots 10 of the reel core 3 are of symmetrical design with respect to a center plane.

Also contributing to the securing of the connection between the ring elements 5, 5' and the reel core 3 are projections 12, which are arranged in a manner distributed over the circumference of the ring elements 5, 5' and by means of which the ring element 5, 5' digs into the paperboard material of the cylinder wall of the reel core 3.

On their inner side, the ring elements 5, 5' have pockets 13 forming toothing for the engagement of shaft stubs (FIG. 5*c*) that rotatably hold and optionally drive the reel 2 and which can be inserted into the ring element 5, 5' as far as a stop 14.

A recess 15, which is oriented toward the latching tongue 7 with the opening 8 and which creates free space for the accommodation of the abovementioned end of the elastomer strand, is formed between two of the pockets 13.

Figure 4:
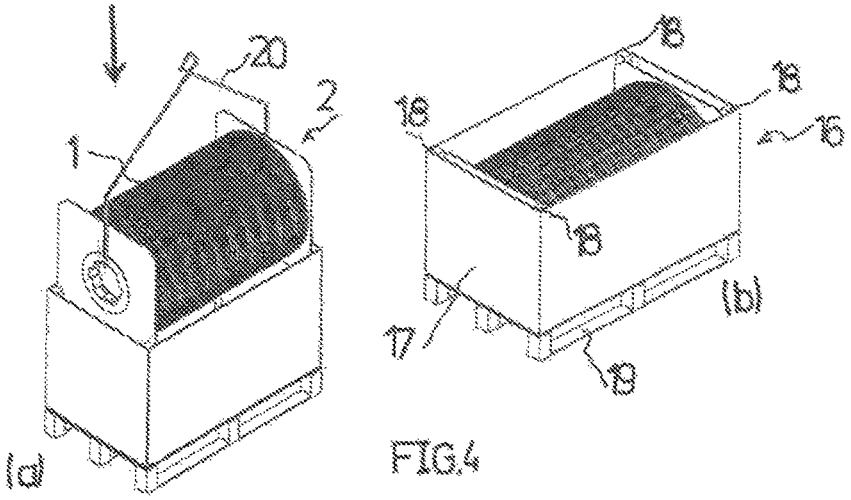
FIG. 4 shows views illustrating the introduction of the wound reel from FIG. 1 into a container.

A container 16, which is shown in FIG. 4 inter alia, is used for packing the reel 2 wound with the elastomer strand 1. The container 16 has four side walls 17 made of paperboard. There is a square support 18 made of wood or paperboard material at each of the four vertical corners in the interior of the container. A double-leaf container lid is not shown in the figures. The container 16 can have a bottom or can be open on the underside. In either case, it can be placed on a pallet 19, on a wooden pallet in the example shown.

If there is a bottom, the wound reel 2 can be lowered into the container 16 on a holding strap 20, which engages in the ring elements 5, 5', wherein the end wall parts 4, 4' are held at a distance from the associated side wall of the container 16 by the square supports. This gives rise to free space for the ring elements 5, 5', the flange 6 of which projects slightly from the end wall parts 4, 4', and for the associated parts of the holding strap 20.

If the container 16 does not have a bottom, it can be placed on the reel, with the result that the reel resting on the pallet 19 occupies the position shown in FIG. 4*b* relative to the container 16.

Figure 5:
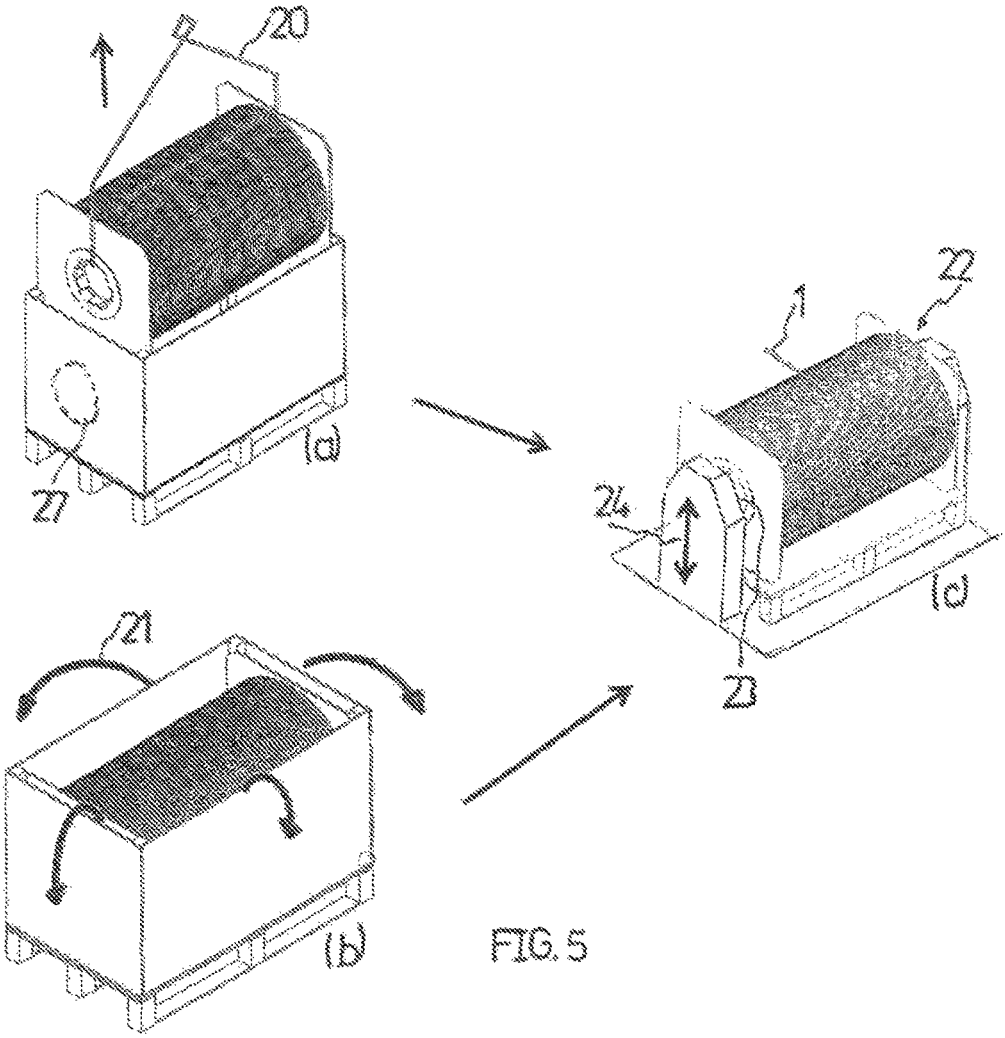
FIG. 5 shows views illustrating the removal of the wound reel from FIG. 1 from the container and the installation of the reel in a holding and rotary drive unit.

According to FIG. 5*a*, a holding strap 20 can also be used to remove the wound reel 2 at the processing location. As an alternative, the paperboard side walls 17 shown in FIG. 5*b*, including the square supports, are merely torn away sideways in accordance with the arrows 21 to expose the wound reel 2.

In accordance with FIG. 5*c*, the exposed reel 2 is then installed in a holding and rotary drive unit 22, which is part of a production system that processes the elastomer strand 1 continuously to form seals on vehicle bodies. Shaft stubs 23 engage in the two ring elements 5, 5'. The shaft stubs 23 can be raised and lowered in accordance with arrow 24, and at least one of the shaft stubs forms a rotary drive in the raised state of the wound reel 2.

A unit corresponding to the holding and rotary drive unit 22 can be used to wind the elastomer strand onto the reel 2 at the manufacturers of the elastomer strand 1.

As indicated by a dashed line at 27 in FIG. 5*a*, the container 16 can have an opening oriented toward the associated ring element or at least one perforation for the formation of such an opening in both of the side walls lying opposite the ring elements 5, 5'. This enables the container to be raised or lowered for stacking or unstacking by means of a holding strap corresponding to the holding strap 20.

Figure 6:
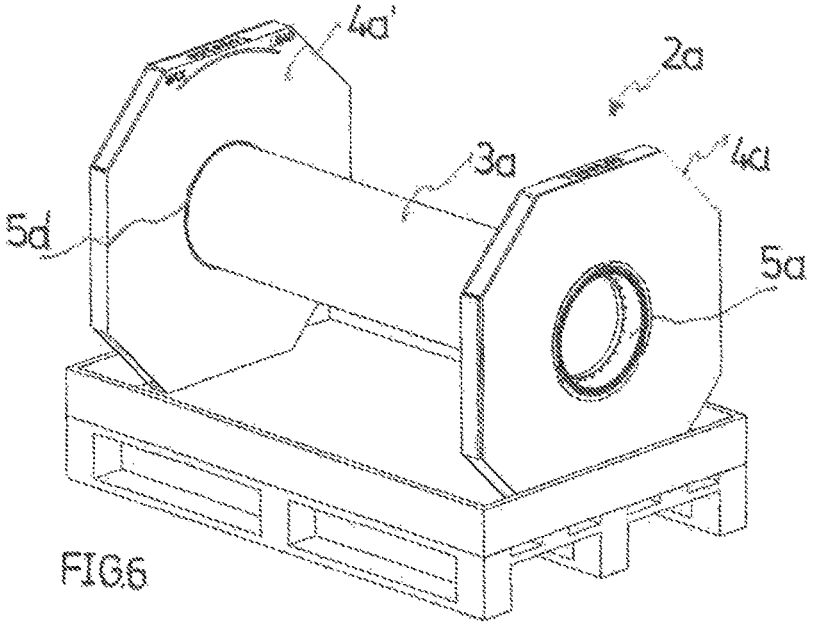
FIG. 6 shows another illustrative embodiment of a reel of a device according to the invention in perspective view.

FIG. 6 shows a reel 2*a*, similar to the reel 2 in FIG. 1, for receiving an elastomer strand 1*a*. The reel 2*a* has a hollow-cylindrical reel core 3*a*, which, like the reel core 3 of the reel 2 in FIG. 1, is composed of paperboard material wound in a spiral. End wall parts 4*a* and 4*a'*, which are likewise composed of paperboard, are each connected to one another via a ring element 5*a* and 5*a'* respectively. Like the ring elements 5, 5' of the reel 2 in FIG. 1, ring elements 5*a*, 5*a'* are composed of recycled plastic and are produced integrally by injection molding.

In contrast to the reel wall parts 4, 4' of the reel 2 in FIG. 1, the end wall parts 5*a*, 5*a'*, one of which is illustrated separately in FIG. 7*a*, are not compose of a single layer of paperboard material but are composed of a paperboard cutout 28 folded in the manner of a box, as illustrated in 7*b*.

The paperboard cutout 28 has octagonal sections 29 and 30, which are connected to one another by an intermediate section 31 bounded by fold edges. Each of the sections 29, 30 furthermore has three foldable attached sections 32, wherein the attached sections 32 of section 29 are each provided with a direct tab 33, and a receiving slot 34 for one of the tabs 33 is formed in each case between section 30 and the three attached sections 32 of section 30. The octagonal end wall parts 4*a* and 4*a'* illustrated in FIG. 7*a* can be produced by folding around the fold edges illustrated in dashed lines in each case.

Figure 7:
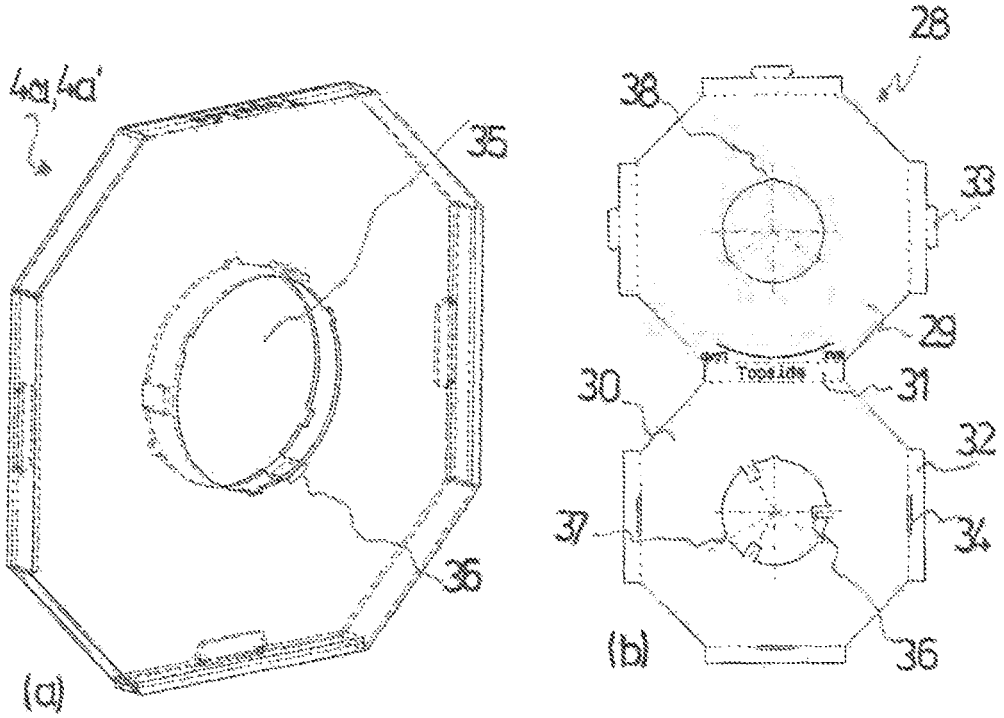
FIG. 7 shows an end wall element of the reel from FIG. 6, said element being formed by folding a paperboard cutout, as well as the paperboard cutout.

As can be seen from FIG. 7, the sections 20, 30 form two mutually spaced layers of the end wall parts 4*a* and 4*a'* and each have a circular opening with a different inside diameter, by means of which an opening 35 is formed in the folded end wall part. As explained below the central point of the circular opening is not precisely in the center of the octagonal sections 29, 30 forming the layers but is arranged eccentrically with respect to said sections. In the example shown, three lugs 36 project from the edge of the associated opening in section 30, and these lugs can be angled by 90° in such a way that they rest against the other section 29 as a stabilizing spacer in the folded end wall part 4*a* or 4*a'*.

In addition to the lugs 36, the opening in section 30 of the cutout 28 has three edge recesses 37, which, like the lugs 36, are arranged at an angular interval of 120° to one another. The opening in section 29 also has edge recesses 38 in a uniform arrangement relative to one another but offset by 60° relative to the edge recesses 37.

Figure 8:
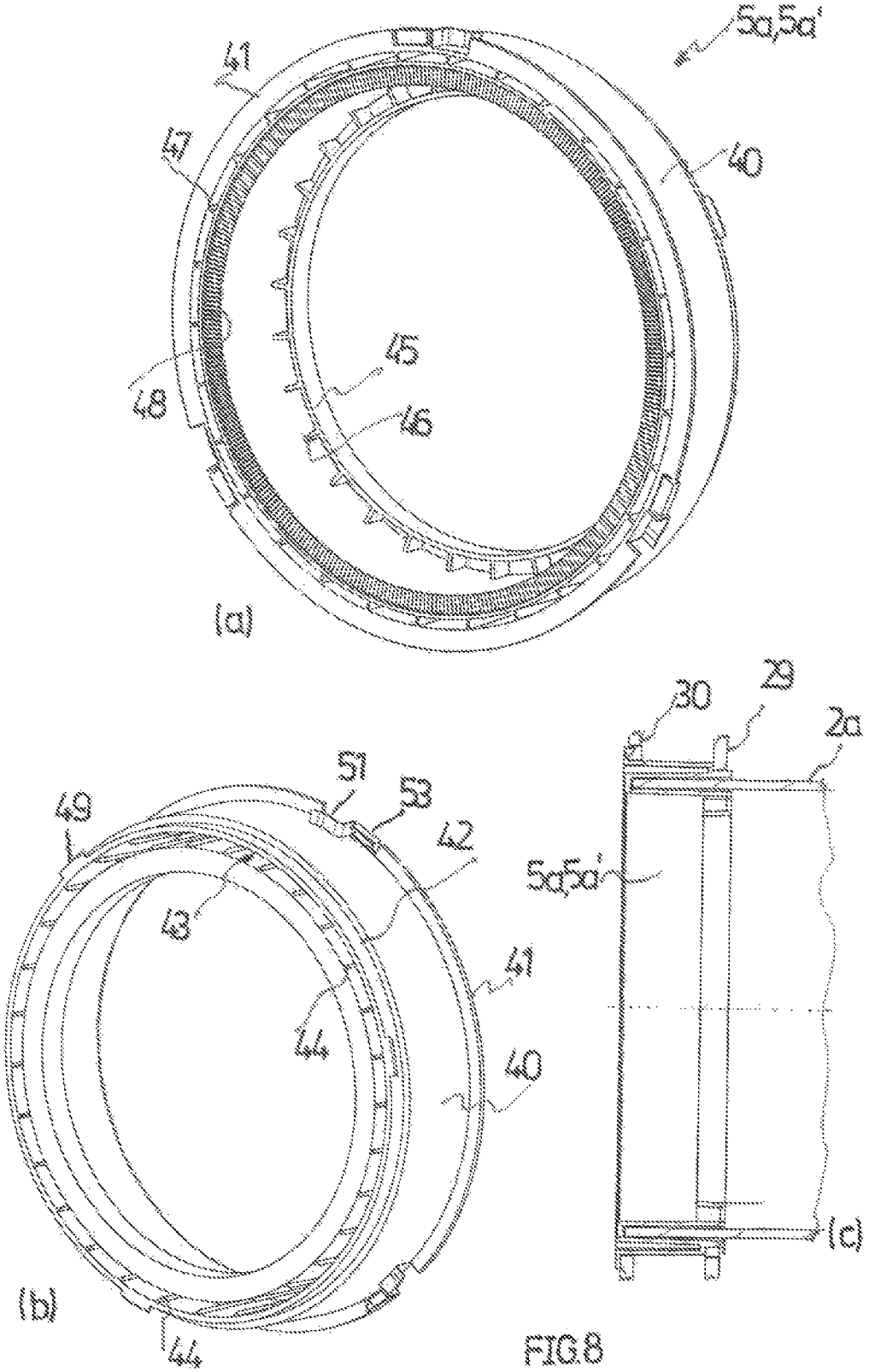
FIG. 8 shows a ring element used in the reel in FIG. 6 in various perspective views and in a sectioned view.
Figure 9:
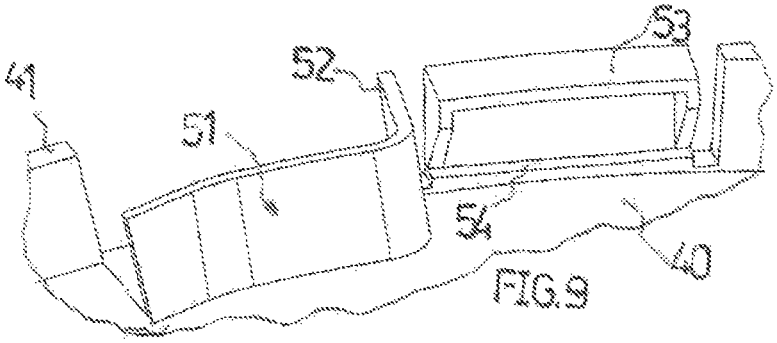
FIG. 9 shows a detail of the ring element from FIG. 8, FIGS. 10-12 show views illustrating the assembly of the reel from FIG. 6.

FIG. 8 shows one of the two corresponding ring elements 5*a*, 5*a*' in three different views. The ring elements have an outer circumferential surface 40, from which a flange 41 projects radially outward at the outer ring edge of the ring element. The outer circumferential surface 40 is furthermore provided with a stepped offset 42, which can be seen in FIG. 8*b*.

A ring pocket 43 opens toward the inner front face of the ring element 5*a* and 5*a*'. Clamping webs 44 project from mutually opposite inner walls of the ring pocket 43, wherein the clamping webs 44 are distributed over the circumference of the ring element, and the clamping webs on one inner wall are arranged offset with respect to the clamping webs on the opposite inner wall of the ring pocket 43.

Adjoining the inner end wall toward which the ring pocket 43 opens, the ring element is reinforced by a radially inward-projecting ring shoulder 45, wherein the ring shoulder has a cavity which is open toward the outside of the ring element and which is interrupted by supporting webs 46 arranged in a manner distributed around the ring circumference. A cavity of this kind, which avoids accumulations of material, having supporting webs 47 distributed around the circumference of the ring element also opens toward the outer front face of the ring element, wherein this cavity is closed toward the inside of the ring element by the stepped offset 42.

On the outer front face of the ring element there is toothing 48 coaxial with the ring axis, wherein 360 teeth are formed in the example shown. Each tooth occupies an angular range of 1°. The toothing is used for the rotary driving of the reel 2*a* by a correspondingly toothed drive element.

Three radially outward-projecting stop tabs 49 are situated at an angular interval of 120° on the inner edge of the circumferential surface 40 of the ring elements 5 and 5*a*'.

Projecting from the circumferential surface 40 at three interruptions in the flange 41, which are provided at angular intervals of 120°, there is in each case an angled web 51, adjoining the axially extending angled portion 52 of which is a latching element 53, which can be pivoted axially outward elastically around a film hinge 54. The angled webs 51 are arranged offset by 60° in each case with respect to the stop tabs 49.

To assemble the reel 2*a*, the end wall parts 4*a*, 4*a*' are first of all connected to the ring elements 5*a*, 5*a*'. For this purpose, the ring elements are each inserted axially from the outside into the opening 35 of the associated end wall part. Since the inside diameter of the opening in section 30 is larger than the inside diameter of the opening in section 29, the stop tabs 49 can pass unhindered through the first opening. Subsequently, the ring element and the end wall part must then be aligned relative to one another in such a way that the stop tabs 49 can pass through the edge recesses 38 in the opening in section 29.

Figure 10:
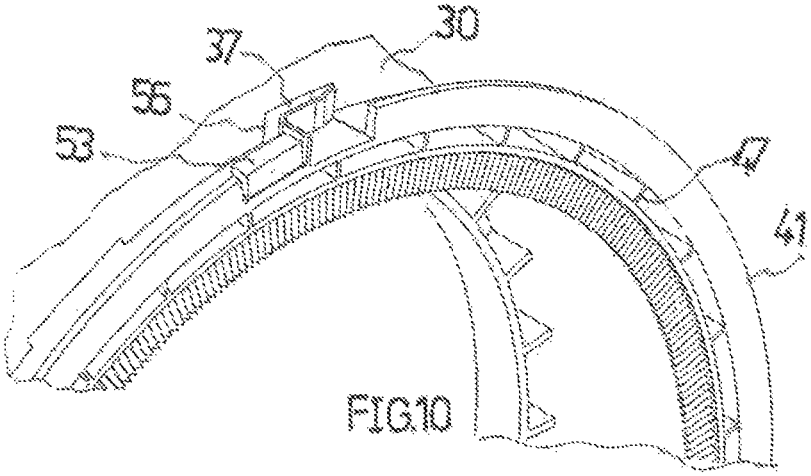

In said aligned position, the edge recesses 37 in section 30 are aligned with the angled webs 51, with the result that said webs can pass through the edge recesses 37 in section 30 of the end wall part, as shown in FIG. 10, wherein pivoting of the latching elements 53 occurs.

To produce a firm connection between the ring elements and the end wall parts, the end wall parts are finally twisted relative to the ring elements, with the result that the stop tabs 49 and the webs 51 engage behind sections 29 and 30 of the end wall part in the manner of a bayonet joint. In the twisted state, in which the webs 51 then engage behind section 30, the three latching elements 53 can then pivot back into the edge recesses 37, with the result that the end wall part is fixed on the ring element in the relevant rotational position since the latching element 53 rests against one edge section 55 of the edge recess 37. Axially, section 29 is enclosed between the stop tabs 49 and the stepped offset 42, while section 30 is enclosed between the flange 41 and the webs 51.

Figure 11:
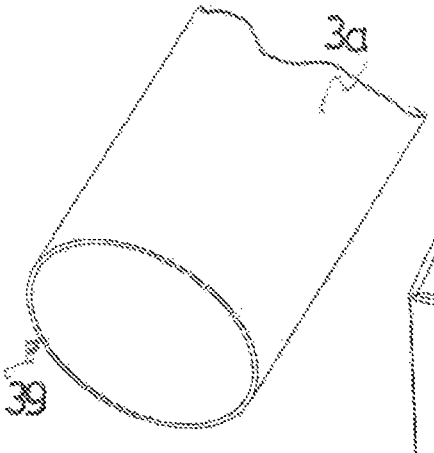
Figure 12:
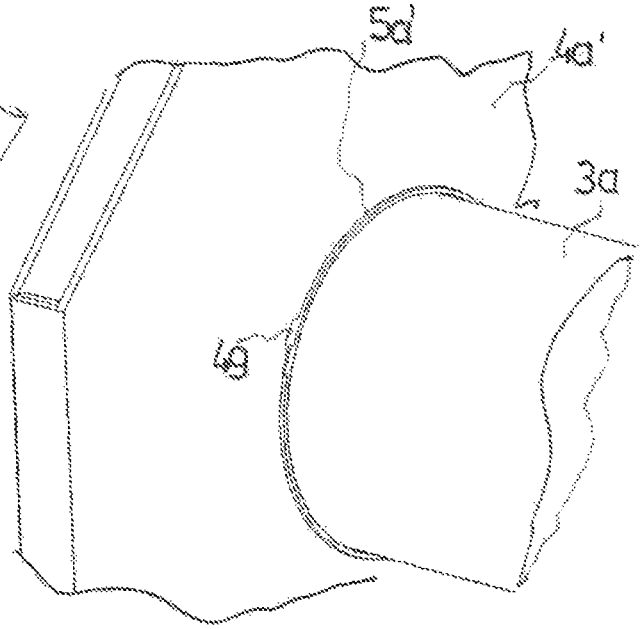

The end wall parts 4*a*, 4*a*' with the inserted ring elements 5*a*, 5*a*' can then be pushed axially onto the front ends 39 of the hollow-cylindrical reel core 3*a* in accordance with FIG. 12, a section of said reel core being illustrated separately in FIG. 11. The projecting clamping webs 44 ensure a firm clamped joint.

When connecting the reel core 3*a* to the end wall parts 4*a*, 4*a*', it has merely to be ensured that the end wall parts 4*a*, 4*a*' are aligned relative to one another in such a way that the intermediate sections 31 extend parallel to one another in the longitudinal direction. It is expedient if the reel 2*a* is supported on a base in such a way that the intermediate sections 31 face upward. On the opposite side, the connection produced by tabs and slots between sections 29 and 30 is then additionally secured against unwanted release by the fact that the reel rests on the base.

Figure 13:
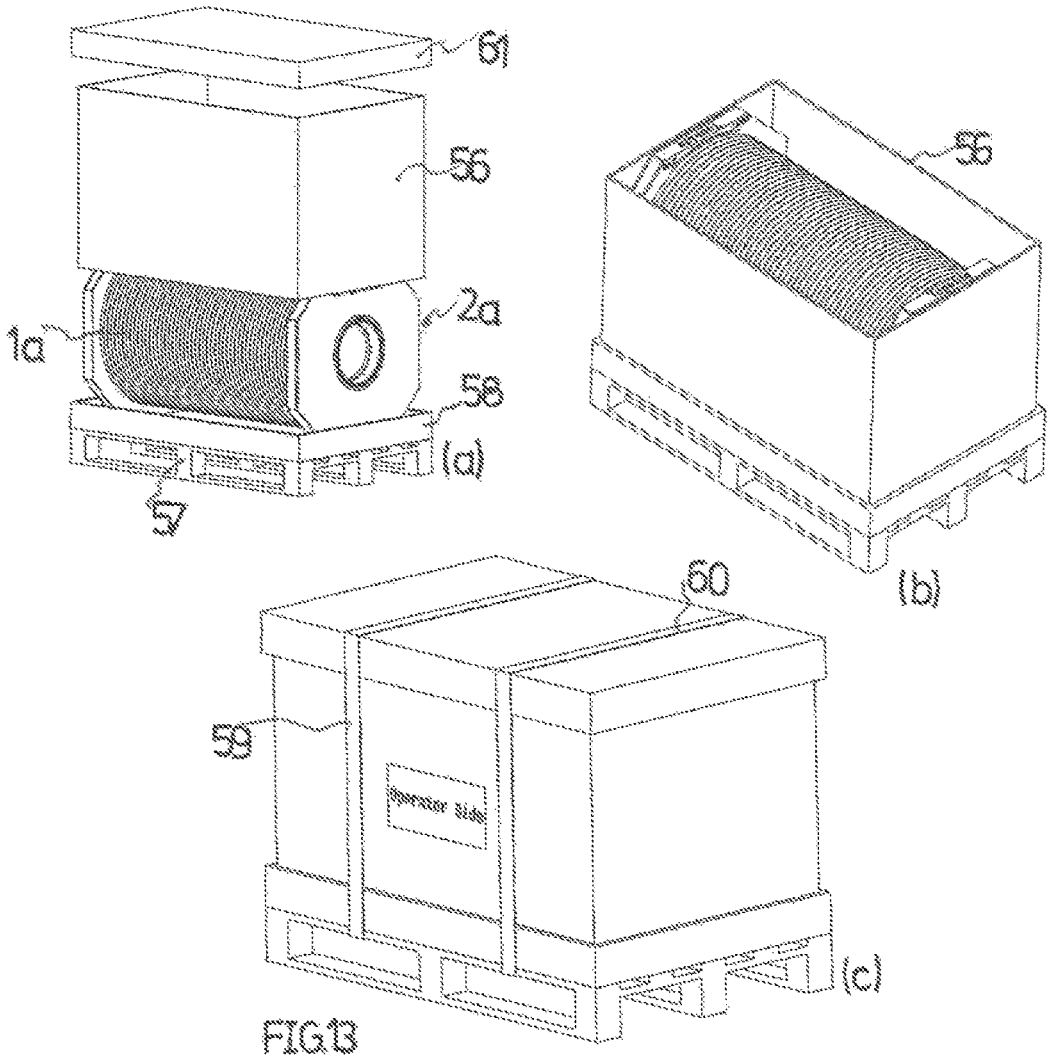
FIG. 13 shows a view illustrating the packing of the reel from FIG. 6 in a container.

FIG. 13 shows the reel 2*a* wound with the strand material 1*a* for the seal, said reel resting on a carrier pallet 57 having an upward-projecting peripheral edge 58. For packing, a case element 56, which is open at the top and the bottom, which forms side walls and the lower edge of which rests on the inside of the peripheral edge 58 on the carrier pallet 57, is placed over. A lid 61 secured by closure straps 59, 60 closes off the package at the top. The peripheral edge 58 could be formed by a part which corresponds to the lid 61, is connected to a lower wooden part of the carrier pallet 57 and is turned through 180° relative to the lid 61.

During unpacking, after the release of the closure straps 59, 60 and removal of the lid 61, the case element 56 is finally lifted off upward, folded up and disposed of.

Figure 14:
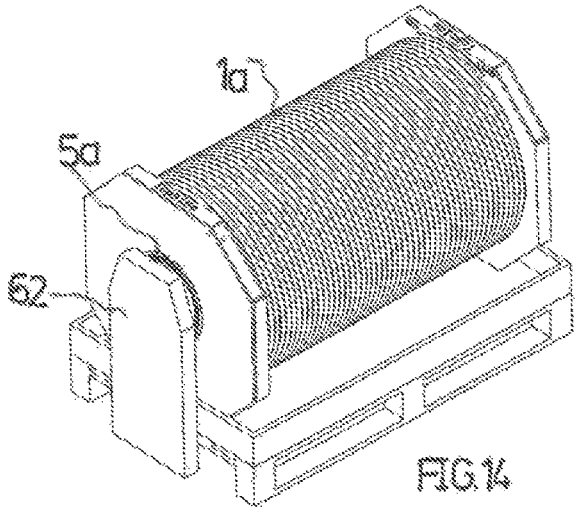
FIG. 14 shows the reel from FIG. 6 with drive units for rotating the reel.

FIG. 14 shows drive elements 62 of a production facility, which engage in the ring elements 5*a*, 5*a*' and by means of which the reel 2*a* is raised, held and rotated. The drive elements 62 have axle stubs (not shown) having a stepped offset, on which toothing corresponding to the toothing 48 is formed. There is advantageously no need of special alignment of the reel relative to this drive toothing. Misalignment, which is always less than half a degree, can be compensated without problems by the play of the drive element carrying the drive toothing.

The drive described above is based both on positive engagement and on nonpositive engagement. It is self-evident that, with increasingly fine angular pitch of the toothing, the drive becomes a purely nonpositive drive.

The invention claimed is:

1. A device for receiving an extruded elastomer strand during transport of the elastomer strand to a processing location, comprising a rotatable reel that receives the elastomer strand as a coil, wherein the reel is provided for temporary inclusion in a production facility that continuously processes the elastomer strand, while the reel is rotated, to form seals for doors or trunks of vehicle bodies, wherein the reel has an average density resulting from a quotient of a total mass and a total volume of a material of the reel that is <2.5 g/cm$^3$, wherein the reel includes a reel core and an end wall at least one part of the reel is composed of a stronger material than remaining parts of the reel, said at least one part being decisive for connection between the reel core and the end wall of the reel, wherein the reel core is at least partially hollow-cylindrical and the at least one part is a ring element that connects the reel core and the end wall together to form the reel, wherein the ring element is connected to the end wall by positive engagement and to the reel core by frictional engagement, wherein, for connection to the end wall, the ring element is insertable axially into an opening in the end wall until the end wall strikes against a flange and/or a stepped offset on the ring element, and wherein the end wall is a folded cutout that has two parallel layer segments arranged at a distance from one another and connected to one another at an edge.

2. The device according to claim 1, wherein the reel is composed predominantly or entirely of a material with a density of <2.0 g/cm$^3$.

3. The device according to claim 2, wherein the percentage by mass of the material is over 60%.

4. The device according to claim 3, wherein the percentage by mass of the material is over 70%.

5. The device according to claim 2, wherein the material has a density of <1.5 g/cm$^3$.

6. The device according to claim 5, wherein the material has a density of <1 g/cm$^3$.

7. The device according to claim 1, wherein the material is a paperboard, a foam and/or a fiber material.

8. The device according to claim 1, wherein the at least one part is stressed directly by contact by being included in the production facility.

9. The device according to claim 1, wherein, for connection to the ring element, the reel core is placeable axially on an outer circumferential surface of the ring element or inserted axially into a ring pocket of the ring element.

10. The device according to claim 1, wherein an outer of the layer segments of the end wall is provided for striking against the flange, and an inner of the layer segments of the end wall is provided for striking against the stepped offset of the ring element.

11. The device according to claim 1, wherein, in one rotational position relative to the end wall, the ring element has stop elements that engage behind the layer segments of the end wall.

12. The device according to claim 11, wherein the ring element comprises devices for latching the end wall in the one rotational position.

13. The device according to claim 1, wherein the ring element has toothing coaxial with a ring axis and axially projecting teeth for engagement of a correspondingly toothed drive element for driving the reel in rotation, wherein the toothing has an angular pitch is of a fineness so that misalignments of the drive element due to backlash are automatically compensated.

14. The device according to claim 13, wherein the toothing has an angular pitch of <2°.

15. A device receiving an extruded elastomer strand during transport of the elastomer strand to a processing location, comprising a rotatable reel that receives the elastomer strand as a coil, wherein the reel is provided for temporary inclusion in a production facility that continuously processes the elastomer strand, while the reel is rotated, to form seals for doors or trunks of vehicle bodies, wherein the reel has an average density resulting from a quotient of a total mass and a total volume of a material of the reel that is <2.5 g/cm$^3$, wherein the reel includes a reel core and an end wall at least one part of the reel is composed of a stronger material than remaining parts of the reel, said at least one part being decisive for connection between the reel core and the end wall of the reel, wherein the reel core is at least partially hollow-cylindrical and the at least one art is a ring element that connects the reel core and the end wall together to form the reel, wherein the ring element is connected to the end wall by positive engagement and to the reel core by frictional engagement, wherein, for connection to the end wall, the ring element is insertable axially into an opening in the end wall until the end wall strikes against a flange and/or a stepped offset on the ring element, and wherein the opening in the end wall is arranged eccentrically with respect to the end wall.

16. A device for receiving an extruded elastomer strand during transport of the elastomer strand to a processing location, comprising a rotatable reel that receives the elastomer strand as a coil, wherein the reel is provided for temporary inclusion in a production facility that continuously processes the elastomer strand, while the reel is rotated, to form seals for doors or trunks of vehicle bodies, wherein the reel has an average density resulting from a quotient of a total mass and a total volume of a material of the reel that is <2.5 g/cm$^3$, wherein the reel includes a reel core and an end wall at least one part of the reel is composed of a stronger material than remaining parts the reel, said at least one art being decisive for connection between the reel core and the end wall of the reel, wherein the reel core is at least partially hollow-cylindrical and the at least one part is a ring element that connect the reel core and the end wall together to form the reel, wherein the ring element is connected to the end wall by positive engagement and to the reel core by frictional engagement, wherein, for connection to the ring element, the reel core is placeable axially on an outer circumferential surface of the ring element or inserted axially into a ring pocket of the ring element, wherein the ring pocket has radially inward-projecting clamping elements distributed over a ring circumference, and wherein clamping elements projecting from mutually opposite inner walls of the ring pocket are arranged offset relative to one another in a circumferential direction.

* * * * *